US006161600A

United States Patent [19]

Borkes

[11] Patent Number: 6,161,600

[45] Date of Patent: Dec. 19, 2000

[54] DEVICE FOR FILLING BAGS WITH BULK MATERIAL

[76] Inventor: Aloys Borkes, Haverkamp 42, NL-7081 DL Gendringen, Netherlands

[21] Appl. No.: 09/367,128

[22] PCT Filed: Feb. 16, 1998

[86] PCT No.: PCT/NL98/00097

§ 371 Date: Aug. 5, 1999

§ 102(e) Date: Aug. 5, 1999

[87] PCT Pub. No.: WO98/35877

PCT Pub. Date: Aug. 20, 1998

[30] Foreign Application Priority Data

Feb. 14, 1997 [NL] Netherlands ..... 1005273

[51] Int. Cl.[7] ..... B65B 1/04; B65B 3/04; B67C 3/00

[52] U.S. Cl. ..... 141/313; 141/10; 141/98; 141/108; 141/114; 141/314; 141/231; 414/724; 414/920

[58] Field of Search ..... 141/10, 98, 108, 141/114, 313, 314, 231; 414/724, 726, 920

[56] References Cited

U.S. PATENT DOCUMENTS

| | | | |
|---|---|---|---|
| 5,004,022 | 4/1991 | Carlsson . | |
| 5,269,579 | 12/1993 | DeCrane . | |
| 5,400,837 | 3/1995 | Kelly et al. | 141/10 |
| 5,590,482 | 1/1997 | Peterson et al. . | |
| 5,787,945 | 8/1998 | Riemersma | 141/314 |

FOREIGN PATENT DOCUMENTS

WO 88/07965 10/1988 WIPO .

*Primary Examiner*—Steven O. Douglas
*Assistant Examiner*—Timothy L. Maust
*Attorney, Agent, or Firm*—Hoffmann & Baron, LLP

[57] ABSTRACT

A filling device (1) for filling bags (5) with bulk material (6), which filling device (1) comprises a carrier (3) which is adapted for fixing to a lifting device (2) and which is provided with a number of load hooks (4) for fastening thereto of a bag (5), which bag (5) is provided for this purpose with fastening means (7) such as loops (7) or eyes (7), characterized in that the load hooks (4) are formed such that during operation a wholly or partially filled bag (5) is automatically released from the load hooks (4) by setting down the bag (5) and moving the lifting device (92) away.

11 Claims, 6 Drawing Sheets

DEVICE FOR FILLING BAGS WITH BULK MATERIAL

FIELD OF THE INVENTION

The invention relates to a filling device for filling bags with bulk material, which filling device comprises a carrier which is adapted for fixing to a lifting device and which is provided with a number of load hooks for fastening thereto of a bag, which bag is provided for this purpose with fastening means such as loops or eyes.

BACKGROUND OF THE INVENTION

Such a filling device is known from EP 376 942 B1. The known filling device comprises a scooping bucket provided on the underside with a closable outlet pipe. On either side of the outlet pipe are arranged two curved hooks for fastening thereto a bag which is provided for this purpose with fastening means.

In practice the known filling device is used in the filling of bags, for instance so-called big bags, with bulk material such as sand, gravel or rubble. For this purpose the filling device is mounted on a lifting device such as a mechanical shovel. Using the lifting device the filling device is then transported to a heap of sand, gravel or other material with which the bag must be filled. The filling device is filled by making scooping movements with the carrier, such as the scooping bucket, in the heap of filling material by appropriate control of the lifting arms of the lifting device. A bag is subsequently fastened to the filled scooping bucket, whereafter the bulk material is poured out of the scooping bucket into the bag by opening the outlet pipe. A filled bag is then transported away from the heap using the lifting device and taken to a predetermined position for further transport. When the lifting device has arrived at the predetermined position the bag is set down and subsequently released from the hooks of the filling device.

In the known filling device the assistance of at least one person is always required for fastening the empty bag to the hooks and for releasing the lowered, filled bag from the hooks. This human operation is particularly time-consuming. The number of bags which can be filled in one hour with the known filling device amounts on average therefore to no more than fifteen. When the driver of the lifting device performs these operations himself, even this number of fifteen bags per hour will in all likelihood not be achieved. This number is however feasible when an additional member of staff performs these operations. Making use of an additional member of staff does however have the effect of increasing costs.

SUMMARY OF THE INVENTION

The invention has for its object to provide a filling device of the type stated in the preamble which obviates the above mentioned drawbacks.

This is achieved according to the invention by providing a filling device characterized in that the load hooks are formed such that during operation a wholly or partially filled bag is automatically released from the load hooks by setting down the bag and moving the lifting device away.

With the filling device according to the invention it is possible to fill approximately sixty bags per hour. This is an improvement of 400% relative to the known filling device.

In a preferred embodiment of the filling device the load hooks are L-shaped, wherein the load hooks are each provided with a leg running substantially parallel to the underside of the carrier. In this embodiment a filled bag remains better suspended from the filling device, also in difficult conditions such as when driving over uneven terrain. In this embodiment the operational safety of the filling device is therefore improved further.

The safety of the filling device is still further improved in a further embodiment in which a locking element is added to at least one load hook for locking the load hook during operation under the influence of the weight of the at least partially filled bag. The locking element is preferably bracket-shaped and the load hook comprises a recess for receiving the bracket-shaped locking element. In this further embodiment there is very little danger of the filled bag detaching from the filling device during operation.

In yet another preferred embodiment of the filling device the carrier is a funnel-like scooping bucket for guiding bulk material, which scooping bucket is provided with an outlet opening, wherein the load hooks are arranged close to the outlet opening. Use of a funnel-like scooping bucket shortens in efficient manner the time required to fill a bag. It thus becomes possible herewith to fill an even larger number of bags per hour.

The invention also relates to a method for filling bags with bulk material using a device as according to any of the foregoing claims, which method comprises the steps of:

fastening the bag to the carrier; and filling the bag with bulk material by moving the carrier with bag at least partially through the bulk material using the lifting device.

BRIEF DESCRIPTION OF THE DRAWINGS

The invention will now be further described with reference to the annexed drawings, in which.

DETAILED DESCRIPTION OF THE PREFERRED EMBODIMENT

Figure 1:
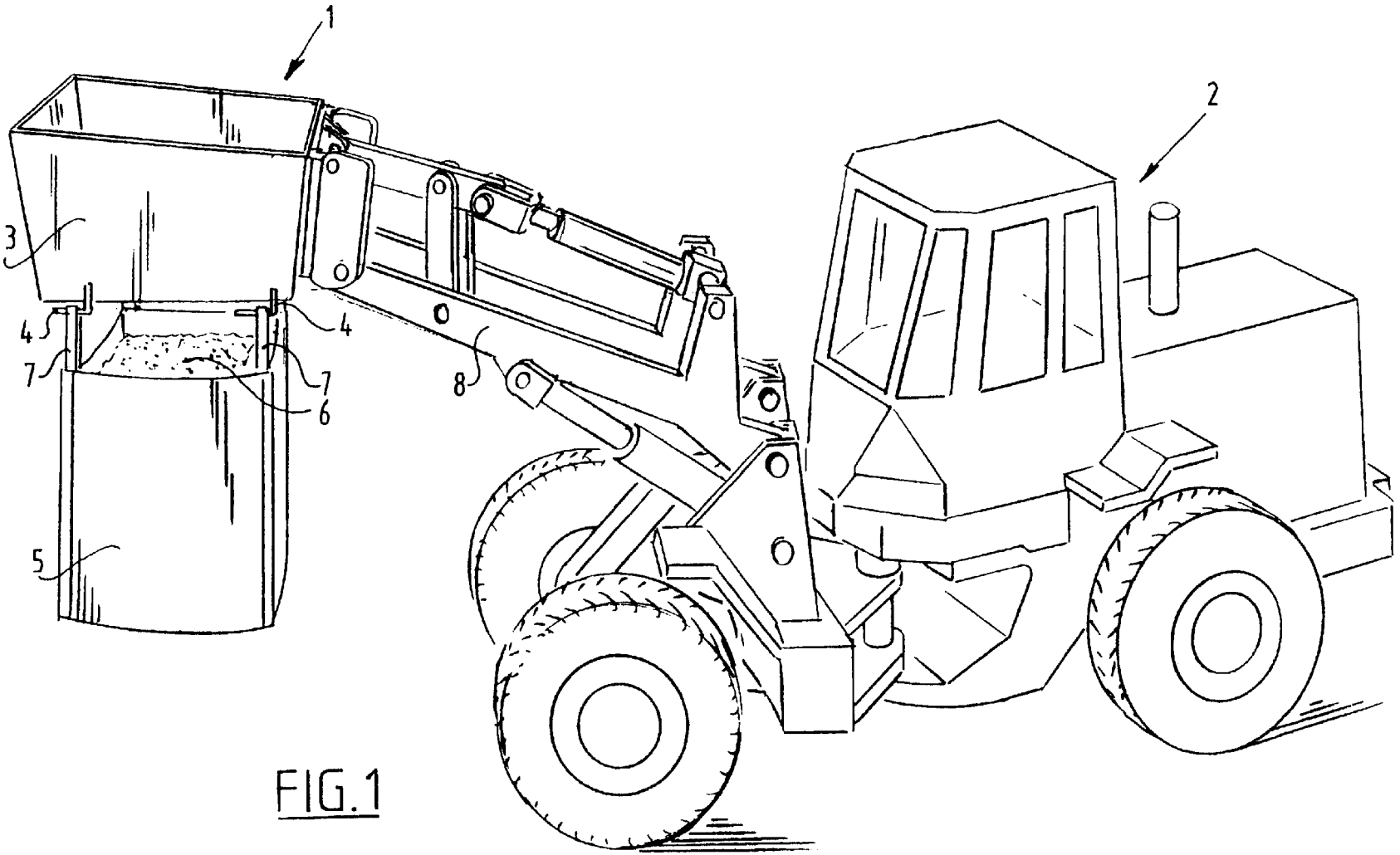
FIG. 1 shows a perspective view of a first variant of a filling device according to the invention mounted on a mechanical shovel.

FIG. 1 shows a filling device 1 according to the invention which is mounted on a lifting device, in this case a mechanical shovel 2, provided with lifting arms 8. Filling device 1 comprises a carrier 3 in the form of a scooping bucket which is provided on the underside with four load hooks 4 for fastening thereto of a bag 5 which is provided for this purpose with loops 7. For the purpose of illustration bag 5 is filled with filling material 6, which can be for instance sand or gravel or other bulk material.

Load hooks 4 are formed such that during operation the bag is automatically released from the load hooks by setting down the bag and driving away the lifting device. In the shown embodiment load hooks 4 are L-shaped, wherein the legs of the load hooks lie at an angle α relative to each other which is greater than 90° (see FIG. 2). Use of the L-shaped load hooks achieves that after setting down of the filled bag 5 the loops 7 of bag 5 slide off load hooks 4 as a result of lifting device 2 being driven away. Bag 5 is hereby released from filling device 1 without any human or mechanical intervention being necessary.

The filling device according to the invention is particularly suitable for use in filling the so-called big bags known in the professional field. Such a big bag is shown in the figures in each case provided with four loops. The filling device according to the invention is similarly provided with four load hooks. The number of load hooks of the filling device according to the invention can of course be adapted to the number of loops or eyes or other fastening means of the bag for filling.

The mounting of the filling device according to the invention on a lifting device such as a mechanical shovel can take place using all means known for this purpose in the professional field.

Figure 2:
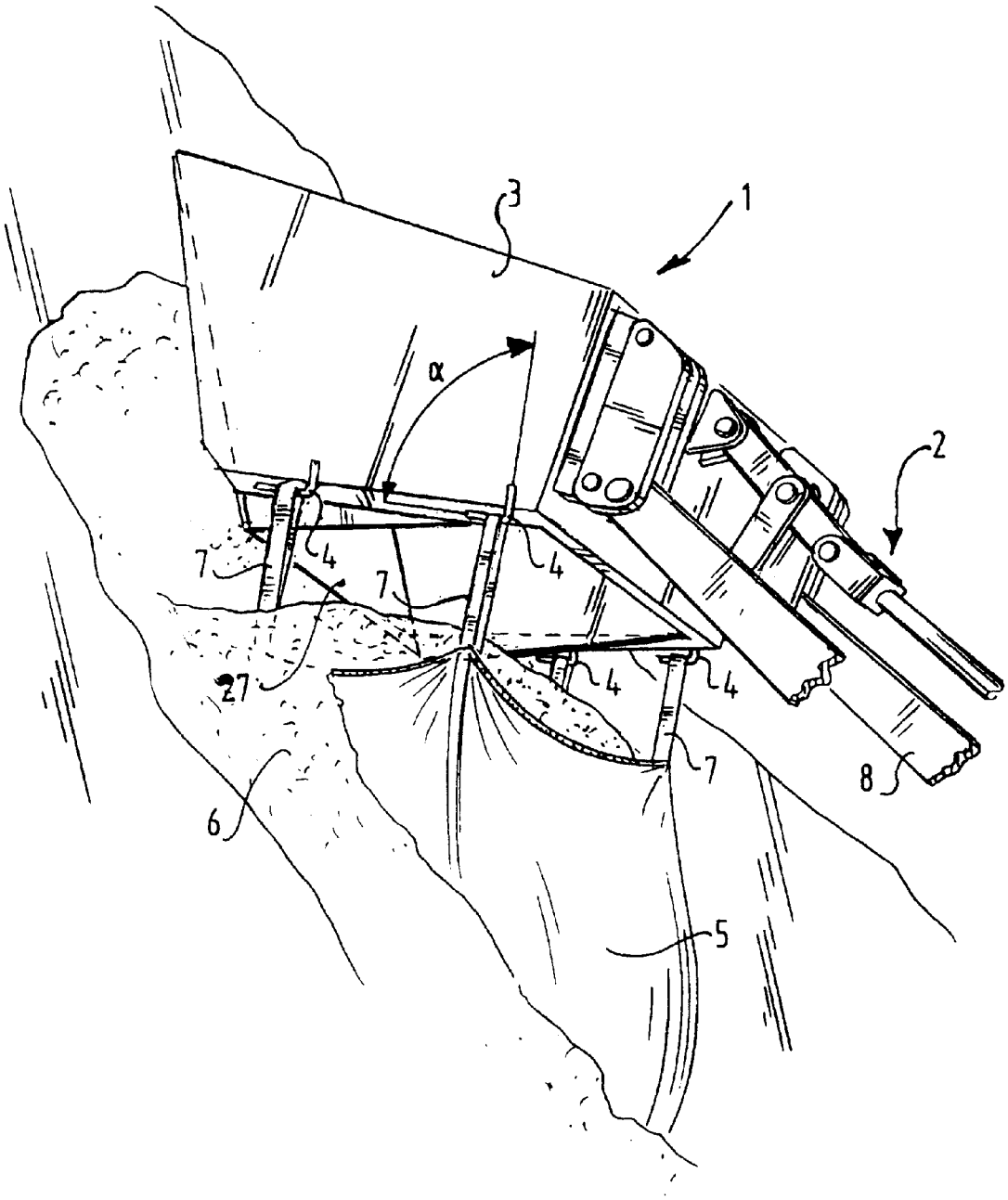
FIG. 2 shows the variant of FIG. 1 in operation during filling of a bag.

FIG. 2 shows in slightly schematic manner the filling device 1 according to the invention in operation during filling of a bag 5 Using lifting arms 8, scooping bucket 3 is tilted such that filling material 6 is scooped into the bag using scooping bucket 3. Scooping bucket 3 is provided for this purpose with a "false bottom". This false bottom is formed by a plate 9 arranged at a certain angle relative to the inner side of scooping bucket 3. Plate 9 is arranged such that the front load hooks 4 are not moved through the heap of filling material during the filling. As a result hereof the bag 5 remains firmly attached during filling to load hooks 4 of filling device 1 by using loops 7.

Figure 3:
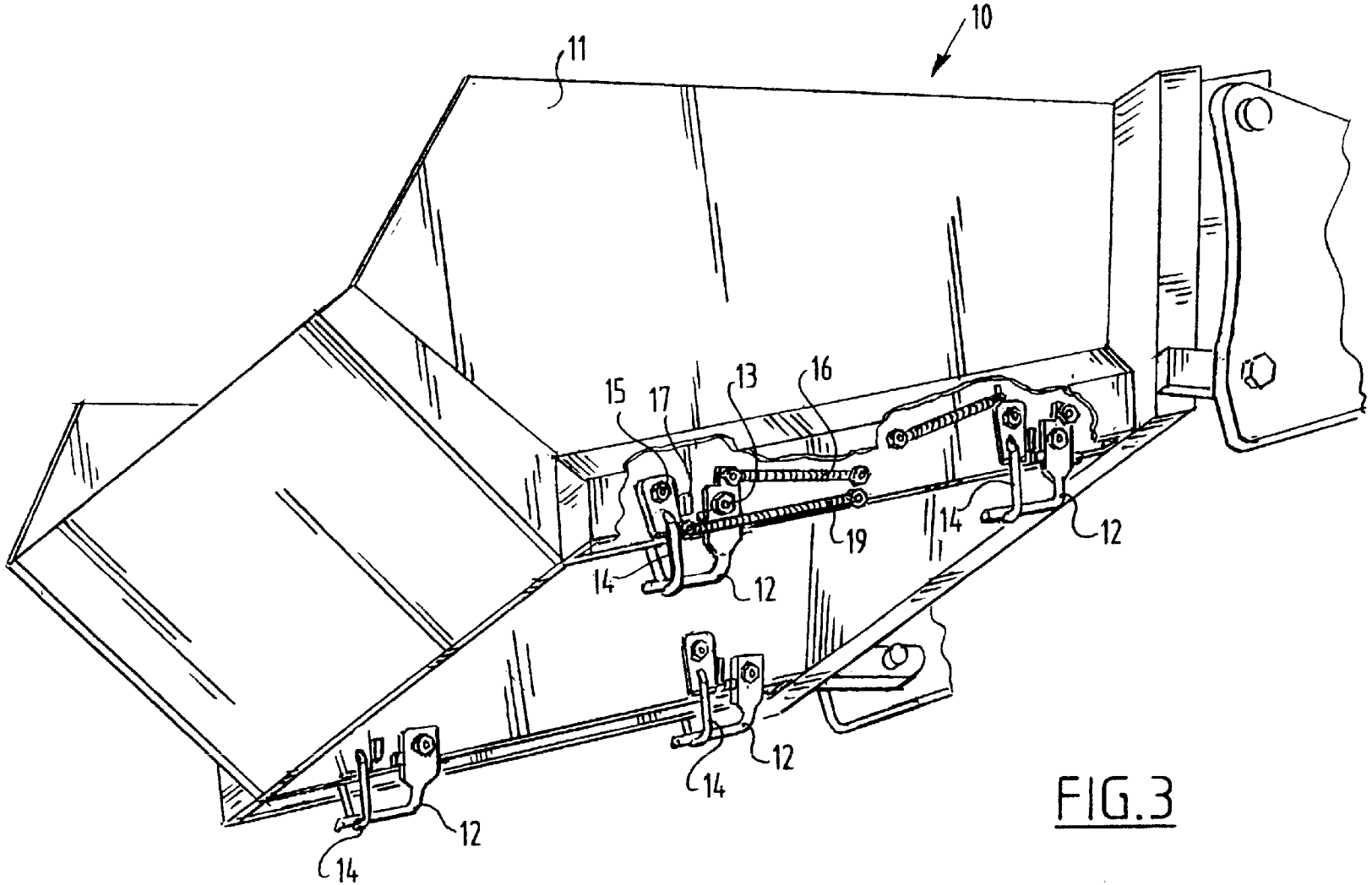
FIG. 3 is a perspective view of a second variant of the filling device according to the invention provided with load hooks with added locking element.
Figure 4:
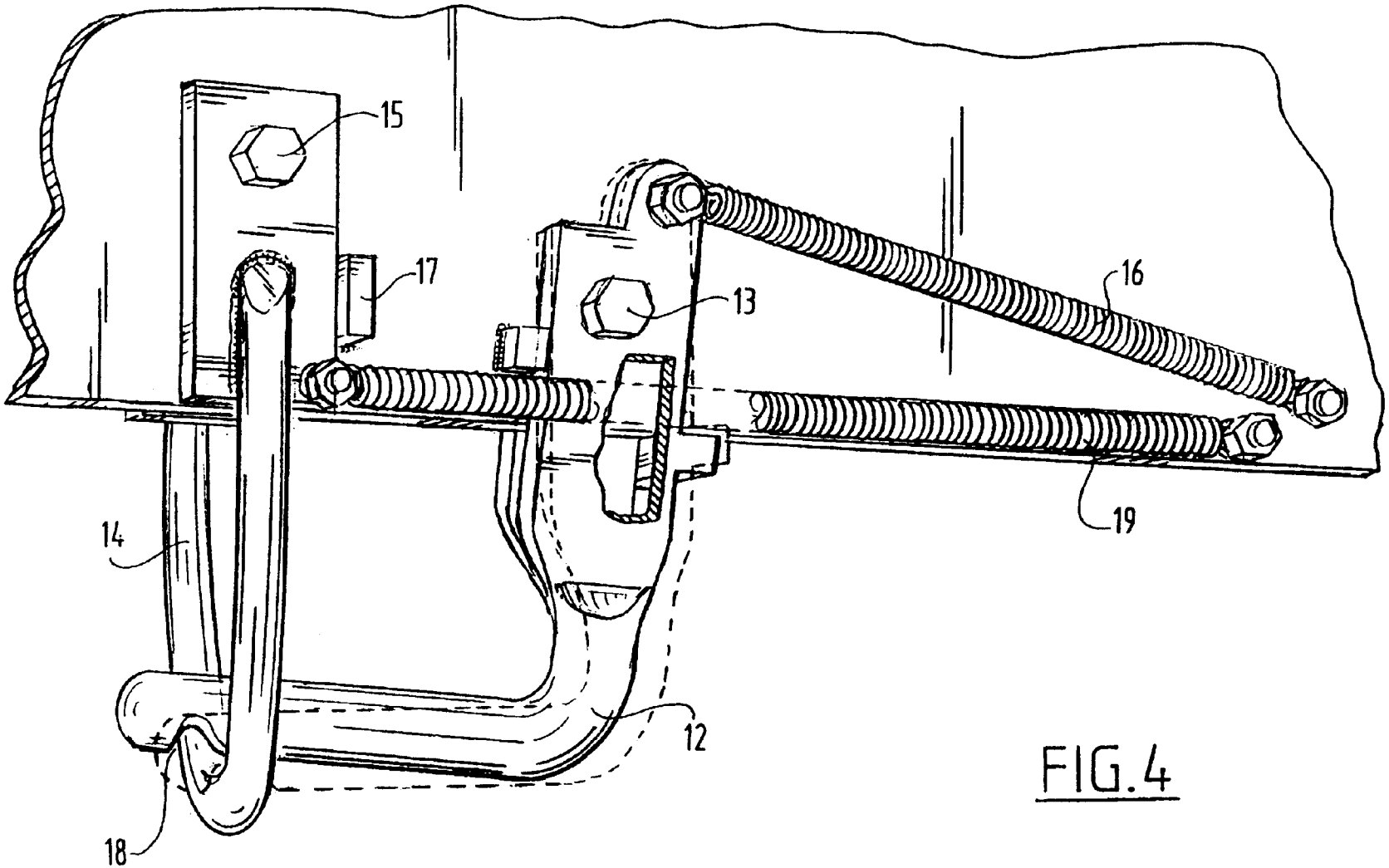
FIG. 4 shows the load hooks of the variant of FIG. 3 in more detail.

FIG. 3 shows a second variant 10 of the filling device according to the invention. Filling device 10 comprises a carrier 11 in the form of a funnel-like scooping bucket for guiding the bulk material which is provided with load hooks 12 arranged close to the outlet opening of the scooping bucket. A locking element 14 is added to each of the load hooks 12. One of the load hooks with locking element is shown in more detail in FIG. 4.

Load hook 12 is movable round the shaft of fixing element 13 mounted on carrier 11. Load hook 12 is herein movable between a free position (shown using full lines) and a locking position (shown using broken lines). Locking element 14 is mounted on carrier 11 for movement round the shaft of fixing element 15. Just as load hook 12, locking element 14 is movable between a free position (not shown) and a locking position. Locking element 14 rests against stop 17 in the locking position. Locking element 14 is preferably held in a locking position using tensioning means, such as spring 19. Load hook 12 is provided with a recess 18 with which the load hook engages on the bracket-shaped locking element 14 in the locking position. The movement of the load hook 12 from the free position to the locking position takes place counter to the action of the tensioning means, formed in this embodiment by springs 15. During operation the movement from the free position of the load hook to the locking position thereof will only take place when sufficient pressure is exerted thereon, for instance by an at least partially filled bag 5 which is fastened to the load hook. In advantageous manner this construction therefore enables the load hook to lock itself during operation under the influence of the weight of the bag, while the load hook likewise unlocks itself when the pressure on the load hook falls away, for instance due to the filled bag being set down. By then moving away the lifting device to which the filling device is fixed the locking element 14 will move from the locking position to the free position, wherein the bag is released from the load hook because the loops (or eyes or other fastening means of the bag) slide off the hook. It is noted that this construction with the load hook in the free position and the locking element in the locking position also secures an empty bag fastened thereto.

Figure 5:
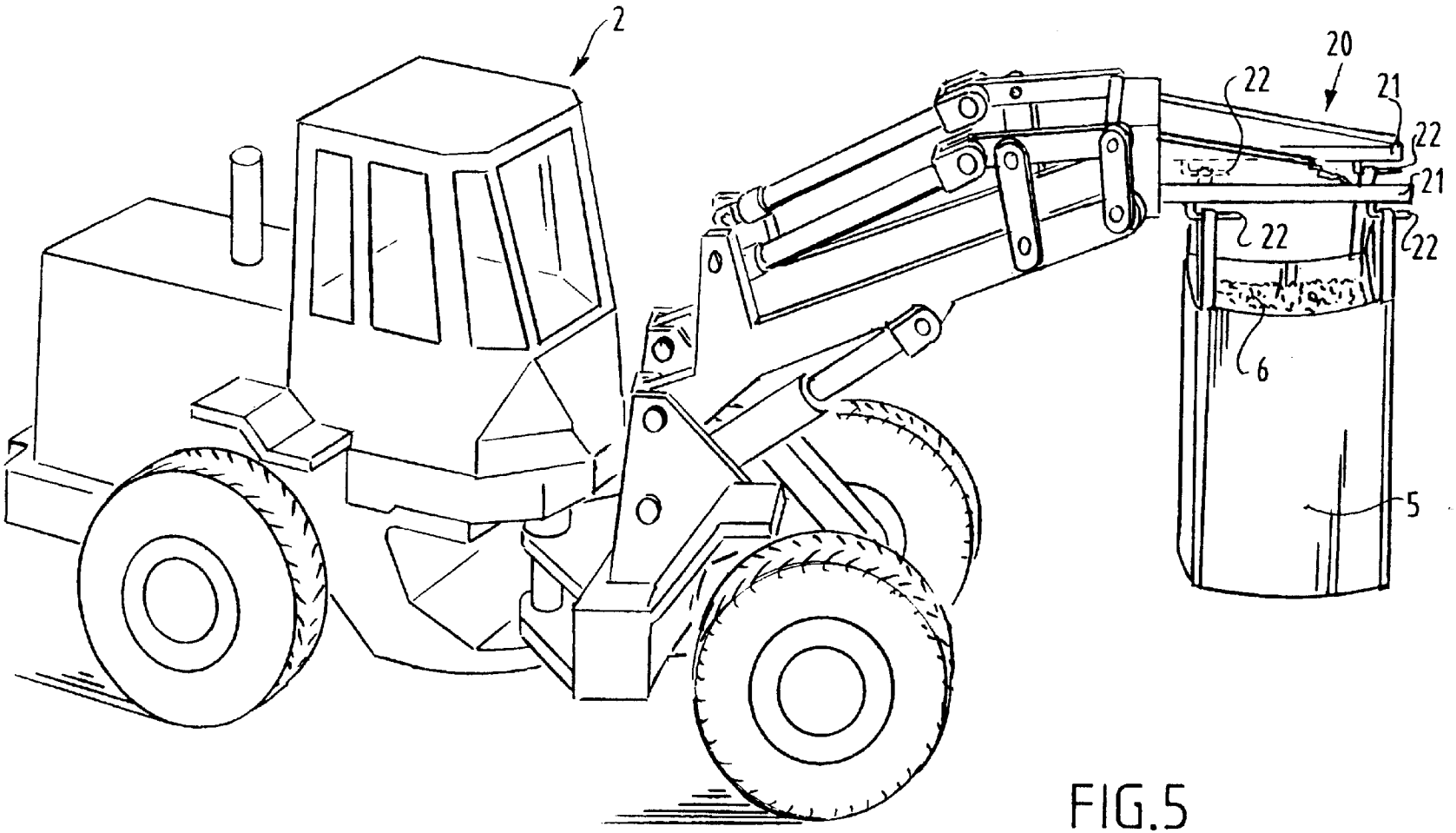
FIG. 5 is a perspective view of a third variant of the filling device according to the invention mounted on a mechanical shovel.

FIG. 5 shows mechanical shovel 2 provided with a third variant 20 of the filling device according to the invention. Filling device 20 consists of two elongate supports 21, which are each provided with two load hooks 22. If desired, the elongate supports 21 can be mutually connected for strengthening purposes by one or more cross beams (not shown). Load hooks 22 are the same as load hooks 4 shown in FIG. 1 and are already described above at some length.

Figure 6:
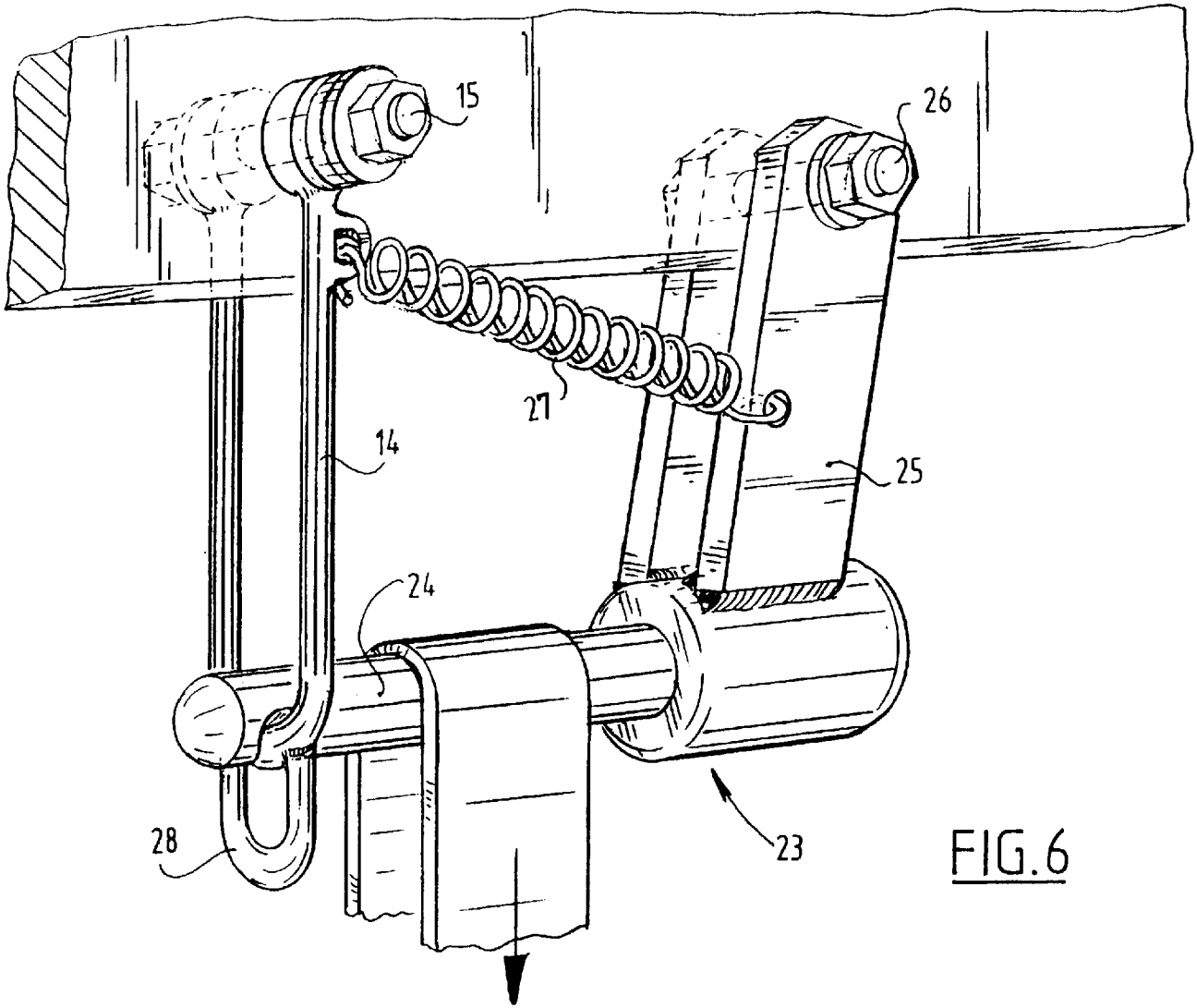
FIG. 6 shows schematically an alternative embodiment of a load hook.

FIG. 6 shows an alternative embodiment of a load hook 23. Added to load hook 23 is a locking element 14 which is movable between a free position and a locking position wholly in accordance with locking element 14 described in FIG. 4. To locking element 14 is added a lip 28 on which the user can exert force to move the locking element between the free position and the locking position. Load hook 23 is substantially L-shaped and comprises two legs 24, 25. Load hook 23 is mounted on the filling device for movement with leg 25 round the shaft of fastening element 26, fully in accordance with load hook 12 in FIG. 4. Movement of load hook 23 from the free position to the locking position takes place counter to the action of spring 27 under the influence of the weight of a bag fastened to the load hook. Leg 24 preferably runs approximately parallel to the underside of the filling device. Legs 24 and 25 lie at a mutual angle which is preferably greater than 90°.

The different embodiments of the carrier and the load hooks according to the invention which are described in the foregoing can be freely combined with each other. This implies that scooping buckets 3 and 11 as well as supports 21 can be provided with load hooks 12 or load hooks 23 with locking element 14 as well as with load hooks 4, 22 respectively.

The present invention is of course not limited to the described and illustrated embodiments, but also includes any other embodiment which is consistent with the foregoing description and the annexed drawings and which falls within the scope of the annexed claims.

What is claimed:

1. Filling device for filling a bag (5) with bulk material (6), said filling device (1) comprises a carrier (3) which is adapted for fixing to a lifting device (2) and which is provided with a number of load hooks (4) for fastening thereto the bag (5), said bag being provided for this purpose with fastening means (7) including loops or eyes, characterized in that, the filling device contains, for efficient filling and handling management, a combination of special structural measures on a carrier (3), which are mounted on lifting and rotating arms (8) of a shovel, wherein said carrier is formed as a scooping bucket absent a bottomplate and whereby upstanding side thereof generally form a prismatic trapezium, wherein the short parallel side is the bottom and forms a filling opening for the bag (5), said short side being sideways structurally reinforced with a profile or beam of folded plate having adjacent the hook ends a special mechanical load hook (4) element with an elongated straight part running substantially parallel to the said bottomside of the carrier (3), wherein behind the front plate of the carrier (3) is constructed a second guiding plate (9) formed at the top for scooping together with a knife edge which diverges to the bottom to form at one end protection for the loops (7)

of the bag (5) placed or hanged on the mentioned special hook (4) elements and at the other end forms a reduced and effective filling opening for the bag (5) so that the material runs into the bag and not on the side of it, wherein a partially or wholly filled bag (5) is automatically releasable from the special mechanical hook (4) elements by setting down the bag (5) and moving the lifting device away in an opposite direction of the elongated part of the hooks (4).

2. Filling device (1) as claimed in claim 1, wherein the load hooks (4) are substantially L-shaped, with an internal hook ($\alpha$).

3. Filling device (1) as claimed in claim 2, wherein a locking element (14) is added to at least one load hook (12) for locking the load hook (12) during operation under the influence of the weight of the at least partially filled bag (5).

4. Filling device as claimed in claim 3, wherein the load hook is movable on a shaft between a free position and a locking position and is provided with tensioning means, wherein the movement from the free position to the locking position takes place during operation to counter the action of the tensioning means under the influence of the weight of the at least partially filled bag, and wherein the locking element is likewise movable between a free position and a locking position, wherein the load hook engages on the locking element in the locking position.

5. Filling device as claimed in claim 4, wherein the locking element is bracket-shaped and wherein the load hook comprises a recess for receiving the bracket-shaped locking element.

6. Filling device as claimed in claim 1, wherein the carrier is a funnel-like scooping bucket for guiding bulk material, which funnel-like scooping bucket is provided with an outlet opening and wherein the load hooks are arranged close to the outlet opening.

7. Filling device as claimed in claim 6, wherein the funnel-like scooping bucket is provided with guide means for guiding the bulk material to the bag during operation, wherein the mentioned guide means are constructed as a double bottom plate.

8. Filling device as claimed in claim 7, wherein the funnel-like scooping bucket is provided on the inner side of the side facing towards the bulk material during operation with a plate for guiding the bulk material which runs at a certain angle relative to said side.

9. Filling device as claimed in any of the claims 1, wherein the carrier consists of two elongated supports which are optionally mutually connected by one or two more cross beams, wherein the load hooks are arranged on the supports, for instance on the bottomside of the supports.

10. Method for filling bags with bulk material using a device as claimed in claim 1, which method comprises the steps of:

fastening the bag to the carrier; and filling the bag with bulk material by moving the carrier with the bag at least partially through the bulk material using the lifting device.

11. Method as claimed in claim 10, which method comprises the further step of:

releasing the at least partially filled bag by setting down the bag and moving the filling device backwards away.

* * * * *